United States Patent [19]

Inoue et al.

[11] Patent Number: 4,881,004

[45] Date of Patent: Nov. 14, 1989

[54] COLOR CATHODE RAY TUBE

[75] Inventors: Masatsugu Inoue; Kiyoshi Tokita, both of Fukaya; Toshinao Sone; Takeshi Fujiwara, both of Kumagaya; Kazunori Nakane, Fukiage, all of Japan

[73] Assignee: Kabushiki Kaisha Toshiba, Kawasaki, Japan

[21] Appl. No.: 236,184

[22] Filed: Aug. 24, 1988

[30] Foreign Application Priority Data

Aug. 26, 1987 [JP] Japan ..... 62-210287
Dec. 11, 1987 [JP] Japan ..... 62-311867

[51] Int. Cl.[4] ..... H01J 29/81; H01J 29/86
[52] U.S. Cl. ..... 313/408; 313/477 R
[58] Field of Search ..... 313/402, 408, 477 R

[56] References Cited

U.S. PATENT DOCUMENTS 4,677,339 6/1987 Inoue et al. ..... 313/408
4,697,119 9/1987 Inoue et al. ..... 313/408

FOREIGN PATENT DOCUMENTS 59-158056 9/1984 Japan .
61-163539 7/1986 Japan .

*Primary Examiner*—Donald J. Yusko
*Assistant Examiner*—Sandra L. O'Shea
*Attorney, Agent, or Firm*—Cushman, Darby & Cushman

[57] ABSTRACT

In a color cathode ray tube, a shadow mask and/or a panel is formed into the following shape. In the shadow mask and/or the panel, a radius of curvature at a central portion in a section taken along an X-Z parallel plane is larger than that at an effective diameter edge portion on the Y axis, and a radius of curvature at an effective diameter edge portion on the X axis is smaller than that at a diagonal effective diameter edge portion. In the panel, a difference between a thickness at an effective diameter edge portion and a thickness on the X axis in a section of the panel taken along a Y-Z parallel plane is maximum at a position between the center of the panel and the effective diameter edge portion on the X axis.

13 Claims, 5 Drawing Sheets

COLOR CATHODE RAY TUBE

BACKGROUND OF THE INVENTION

1. Field of the Invention

The present invention relates to a color cathode ray tube and, more particularly, to an improvement in a face plate and a shadow mask of a color cathode ray tube.

2. Description of the Related Art

FIG. 1 shows a shadow-mask type color cathode ray tube (color-CRT). The tube axis of color cathode ray tube 50 is defined as a Z axis. A major-axis direction perpendicular to the Z axis and passing through center 0 of panel 51 is defined as an X axis. A minor-axis direction perpendicular to the Z and X axes and passing through center 0 of panel 51 is defined as a Y axis. Color cathode ray tube 50 comprises substantially rectangular face plate 52, panel 51 having skirt 54 extending from a side edge portion of face plate 52, and funnel 56 coupled to panel 51. Funnel 56 has substantially cylindrical neck 58 housing an electron gun assembly. A phosphor screen is formed on the inner surface of face plate 52. A rectangular shadow mask is arranged on panel 51 to oppose the phosphor screen. The shadow mask is made of a thin metal plate, and has a large number of slit apertures. The shadow mask is arranged on the inner surface of face plate 52 to be separated at a predetermined distance therefrom. The periphery of the shadow mask is welded to a rectangular frame. Some elastically deformable supporting structures are welded to the frame. Since the supporting structures are engaged with panel pins mounted on panel 51, the shadow mask is supported on panel 51.

A plurality of electron beams emitted from the electron gun assembly housed in neck 58 are converged into the slit apertures of the shadow mask, and then land on the phosphor screen formed on panel 51. The phosphor screen is constituted by a plurality of stripe phosphor layers. The plurality of phosphor layers emit a plurality of colors upon landing of the electron beams. The shadow mask is arranged for causing electron beams to land on the predetermined phosphor layers.

In order to cause the plurality of electron beams to land on the predetermined phosphor layers, over $\frac{2}{3}$ of the electrons of the plurality of electron beams emitted from the electron gun do not pass through the slit apertures, but are bombarded on the shadow mask and are converted to heat. Thus, the temperature of the shadow mask is increased, and the metal shadow mask is thermally expanded. Upon thermal expansion of the shadow mask, he relative position between the slit apertures of the shadow mask and the stripe phosphor layers of the phosphor screen is changed. A change in relative position between the slit apertures of the shadow mask and the stripe phosphor layers of the phosphor screen causes mislanding of the electron beams on the phosphor screen, thus degrading color purity of the color cathode ray tube. In order to correct the mislanding caused by the change in relative position between the shadow mask and the phosphor screen, supporting structures having a bimetal are employed. The supporting structures move the expanded shadow mask in a direction toward the phosphor screen upon movement of the bimetal, so that the distance between the shadow mask and the phosphor screen falls within an allowable range. Thus, the mislanding caused by the change in relative position between the shadow mask and the phosphor screen is corrected. However, when the phosphor screen is caused to emit light at high luminance and electron beams land to be concentrated on a portion of the phosphor screen within a short time interval, the shadow mask near the portion is strongly heated. The local heating of the shadow mask causes local mislanding of the electron beams. The local mislanding is a serious problem in the conventional color cathode ray tube.

U.S. Pat. Nos. 4,535,907 and 4,537,322 disclose an improvement in the panel of a cathode ray tube. U.S. Pat. No. 4,537,321 and Japanese Patent Disclosure (Kokai) No. 59-158056 (U.S. Pat. Serial No. 469,775) disclose a color cathode ray tube having a substantially flat face plate. In particular, since the face plate of the color cathode ray tube described in U.S. Pat. Serial No. 469,775 is substantially flat, mislanding of the electron beams is enhanced when the shadow mask is locally heated. The face plate of the color cathode ray tube, as shown in FIG. 2, has a large difference in distance between the central portion and an effective diameter end portion on the minor axis in the tube-axis direction, i.e., in the Z-axis direction, but has a very small difference in distance between an effective diameter end portion on the major axis and an effective diameter end portion on the diagonal line in the tube-axis direction, i.e., the Z-axis direction. In the panel, the face plate has a very large radius of curvature. Thus, since the peripheral portion of the face plate is substantially flat, the shadow mask also has an almost flat shape. Since the shadow mask is flatter from its central portion toward the peripheral portion, if a portion near the peripheral portion is heated by electron beam bombardment, the relative position between the phosphor screen and the shadow mask is changed, and the mislanding of electron beams is enhanced. As a result, the color purity of the color cathode ray tube is considerably degraded.

In the above problem, in order to examine a region of a color-CRT where local mislanding easily occurs, a signal generator for generating a rectangular window-shaped image pattern is used. The position and shape of the window-shaped pattern are changed to measure the mislanding of the electron beams. FIG. 3 shows beam pattern 5 by a large current for causing almost the entire surface of screen 6 to emit light at high luminance. In pattern 5 shown in FIG. 3, since the entire shadow mask is expanded, local mislanding relatively rarely occurs. FIG. 4 shows relatively elongated raster pattern 7 for causing a portion of screen 6 to emit light at high luminance. The largest mislanding occurs on the region where pattern 7 shown in FIG. 4 is located. The mislanding occurs for the following reasons. First, a CRT is designed such that an average anode current does not exceed a predetermined value. For this reason, a current intensity per unit area of the shadow mask in the pattern shown in FIG. 4 is higher than that in the large window-shaped pattern shown in FIG. 3. As a result, in the pattern shown in FIG. 4, the shadow mask is strongly heated and the temperature is increased rapidly. Second, mislanding most easily occurs at the position of raster pattern 7 shown in FIG. 4. In other words, the relative position between the slit apertures of the shadow mask and the corresponding stripe phosphor layers of the phosphor screen is easily changed at the position of the pattern shown in FIG. 4. This is because, since the electron beams obliquely pass through the slit apertures of the shadow mask, the position which electron beams land on the corresponding stripe phosphor layers of the phosphor screen is easily as well as largely changed by thermal expansion of the shadow mask. However, when the pattern is located near the central portion of the screen, if the shadow mask is thermally expanded due to heat, the direction in which the shadow mask is thermally expanded corresponds to the direction of the electron beams, and so the relative position between the slit apertures of the shadow mask and the corresponding stripe phosphor layers of the phosphor screen is not almost changed. When the pattern is located near the edge portion of the screen, since the shadow mask is fixed to the frame, thermal expansion can be prevented. Thus, mislanding most easily occurs on the region of the raster pattern shown in FIG. 4.

FIG. 5 shows a state of mislanding of electron beams shown in FIG. 4. Supporting structure 66 arranged on frame 63 which is welded to shadow mask 62 is engaged with stud pin 64 arranged on the inner surface of skirt 54 of panel 50. When electron beam 69 lands to cause phosphor screen 60 to emit light at low luminance, shadow mask 62 is not so heated, and is located at position A. In this case, electron beam 69 lands on the correct position of phosphor screen 60. When electron beam 69 lands to cause phosphor screen 60 to locally emit light at high luminance, shadow mask 62 is locally heated to a high temperature and is thermally expanded and shifted to position B. In this case, since slit aperture 63 of shadow mask 62 is moved near phosphor screen 60, the landing position of electron beam 69 on phosphor screen 60 is changed. As a result, the electron beam cannot land on the predetermined position of the phosphor screen.

A method of solving this problem is described in U.S. Pat. Nos. 4,677,339 and 4,697,119. In color cathode ray tubes described in the above patents, a radius of curvature in the Y-axis direction of a section obtained by cutting the shadow mask along a Y-Z parallel plane is changed. In the above patents, only the Y-axis direction of the color cathode ray tube is taken into consideration, whereas the X-axis direction is not taken in consideration.

SUMMARY OF THE INVENTION

It is an object of the present invention to provide a color cathode ray tube which can reduce thermal expansion of a shadow mask although an outer surface of a face plate is formed to be substantially flat, and as a result, can reduce mislanding of electron beams and can obtain high color purity.

According to the present invention, there is provided a color cathode ray tube comprising: a vacuum chamber which has a panel, a funnel, and a neck, and has an axis, and in which the panel has a face plate having a substantially rectangular entire surface and an inner surface, and a skirt having an inner peripheral surface extending from a peripheral edge of the face plate, the funnel is formed into a funnel shape and is contiguous with the skirt of the panel, and the neck is formed into a substantially cylindrical shape and is contiguous with the funnel; a phosphor screen formed on the inner surface of the face plate; an electron gun assembly, arranged in the neck, for emitting three electron beams which land on the phosphor screen; a shadow mask which is arranged in the panel to oppose the phosphor screen, and has a plurality of apertures for allowing the three electron beams from the electron gun assembly to pass therethrough; supporting means for supporting the shadow mask; and deflection means for deflecting the electron beams.

According to the present invention, taking a radius of curvature in an X-axis direction in consideration, mislanding of electron beams caused by thermal expansion of the shadow mask can be eliminated. Thus, high color purity of the color cathode ray tube can be maintained.

DETAILED DESCRIPTION OF THE PREFERRED EMBODIMENTS

Figure 1:
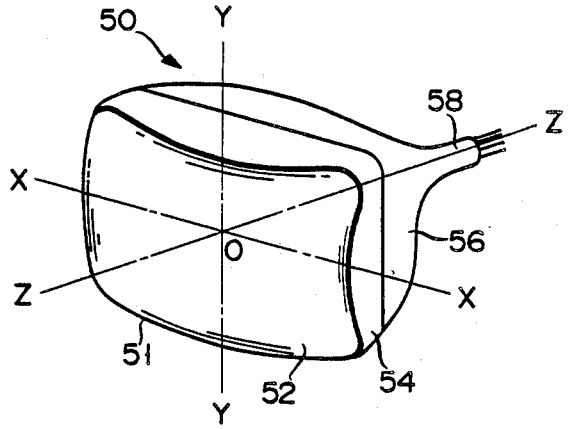
FIG. 1 (PRIOR ART)
FIG. 1 is a perspective view showing a conventional color cathode ray tube.
Figure 2:
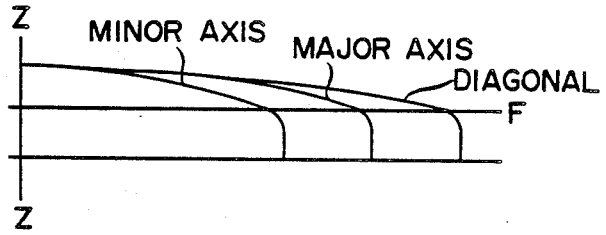
FIG. 2 (PRIOR ART)
FIG. 2 is a view for explaining a section of a panel associated with the conventional color cathode ray tube.
Figure 3:
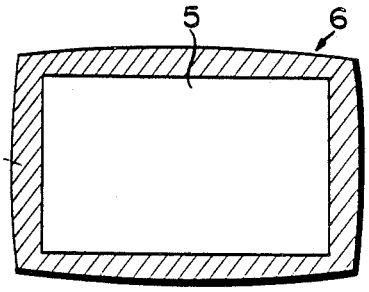
FIG. 3 (PRIOR ART)
FIG. 3 is a view showing an image pattern on the screen of the color cathode ray tube.
Figure 4:
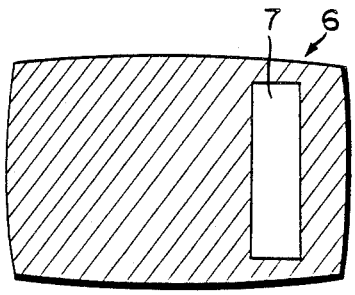
FIG. 4 (PRIOR ART)
FIG. 4 is a view showing an image pattern on the screen of the color cathode ray tube.
Figure 5:
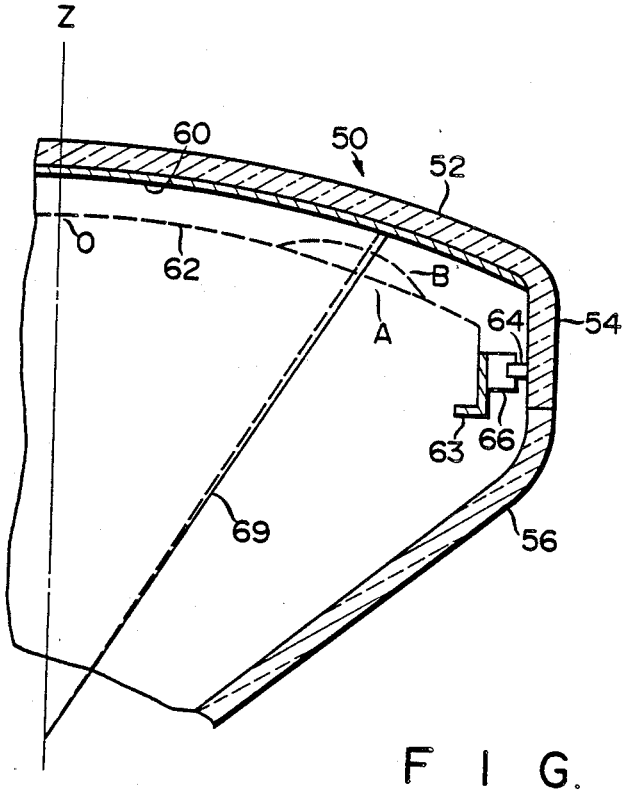
FIG. 5 (PRIOR ART)
FIG. 5 is a view for explaining local deformation of the shadow mask due to heat.
Figure 6:
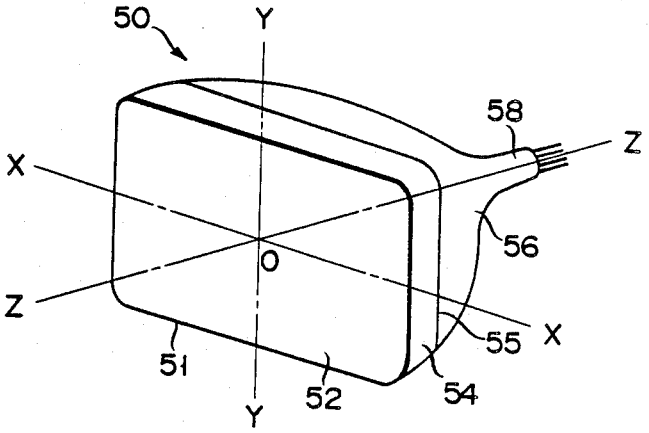
FIG. 6 is a perspective view of a color cathode ray tube according to an embodiment of the present invention.
Figure 7:
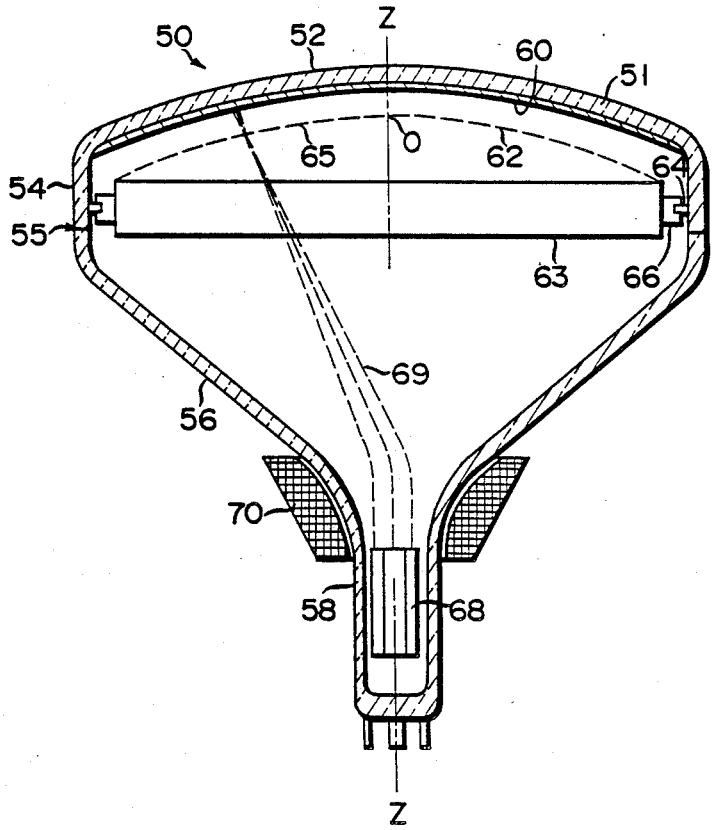
FIG. 7 is a sectional view of the color cathode ray tube according to the embodiment of the present invention.

FIGS. 6 and 7 show color cathode ray tube 50 according to an embodiment of the present invention. Color cathode ray tube 50 comprises panel 51 having substantially rectangular face plate 52 and funnel 56. Skirt 54 extending from the side edge portion of face plate 52 of panel 51 is coupled to funnel 56 at coupling portion 55. Thus, color cathode ray tube 50 is sealed at coupling portion 55 to form a vacuum chamber in a high vacuum state. Color cathode ray tube 50 has neck 58 extending from funnel 56. Phosphor screen 60 is arranged on the inner surface of face plate 52. Three phosphor stripes for emitting three colors, i.e., red, green, and blue are alternately arrayed on phosphor screen 60. Shadow mask 62 is arranged to oppose phosphor screen 60 at a predetermined distance. The tube axis passing through center 0 of shadow mask 62 and the center of neck 58 is defined as a Z axis, a major-axis direction perpendicular to the Z axis and passing through center 0 of shadow mask 62 is defined as an X axis, and a minor-axis direction perpendicular to the Z and X axes and passing through center 0 of shadow mask 62 is defined as a Y axis. The peripheral portion of shadow mask 62 is welded to rectangular frame 63. Frame 63 has elastically supporting members 66 engaged with stud pins 64 embedded in skirt 54 of panel 51. Thus, shadow mask 62 is elastically held on panel 51 by elastically supporting members 66. A large number of slit apertures 65 are formed longitudinally in shadow mask 62 in a direction parallel to the extending direction of the stripes of phosphor screen 60, i.e., along the Y-axis direction. Slit apertures 65 are formed in rectangular region 74 indicated by a broken line in FIG. 8. Rectangular region 74 forms an effective region for displaying an image. Deflection yoke 70 for generating a magnetic field is arranged outside funnel 56 and near neck 58. Inline electron gun 68 for emitting electron beams is housed in neck 58.

Three electron beams 69 are emitted from inline electron gun 68. Emitted three electron beams 69 are deflected by the magnetic field generated by deflection yoke 70. Deflected three electron beams 69 are converged into slit apertures 65 of shadow mask 62, and are bombarded on phosphor screen 60 on panel 52. Thus, electron beams 69 scan shadow mask 62 and phosphor screen 60. In this case, electron beams which cannot pass through the slit apertures of shadow mask 62 are bombarded on shadow mask 62 and are converted into heat.

Figure 8:
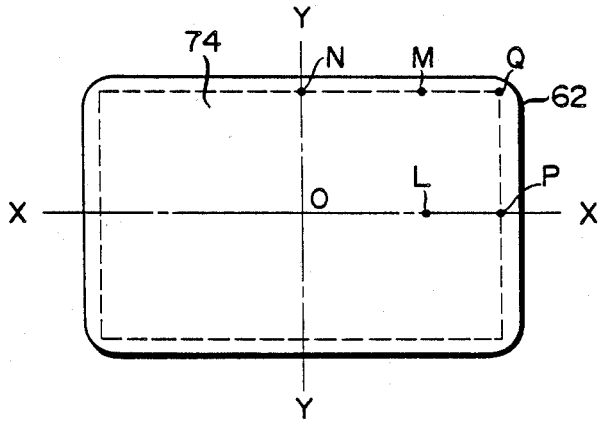
FIG. 8 is a plan view showing a shadow mask according to the embodiment of the present invention.
Figure 9:
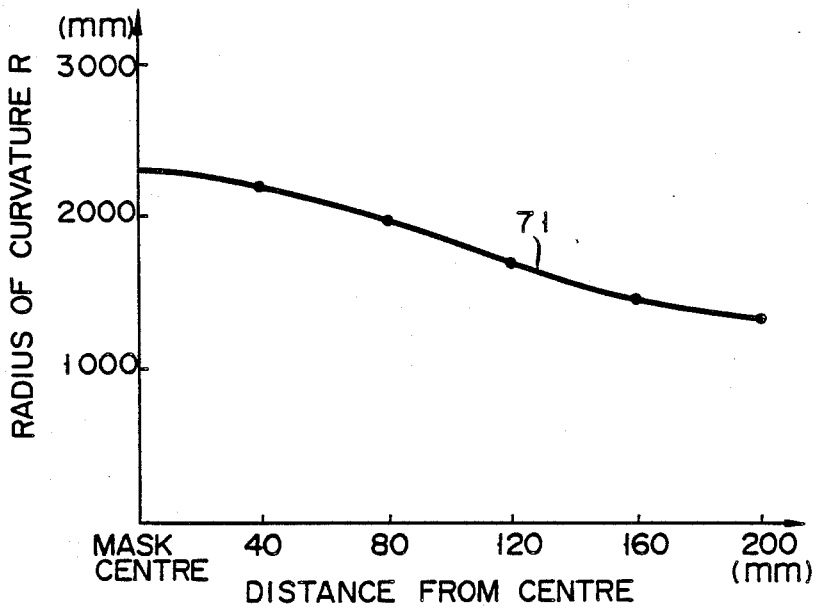
FIG. 9 is a graph showing the relationship between a radius of curvature and a distance from the center of the shadow mask according to the embodiment of the present invention.
Figure 10:
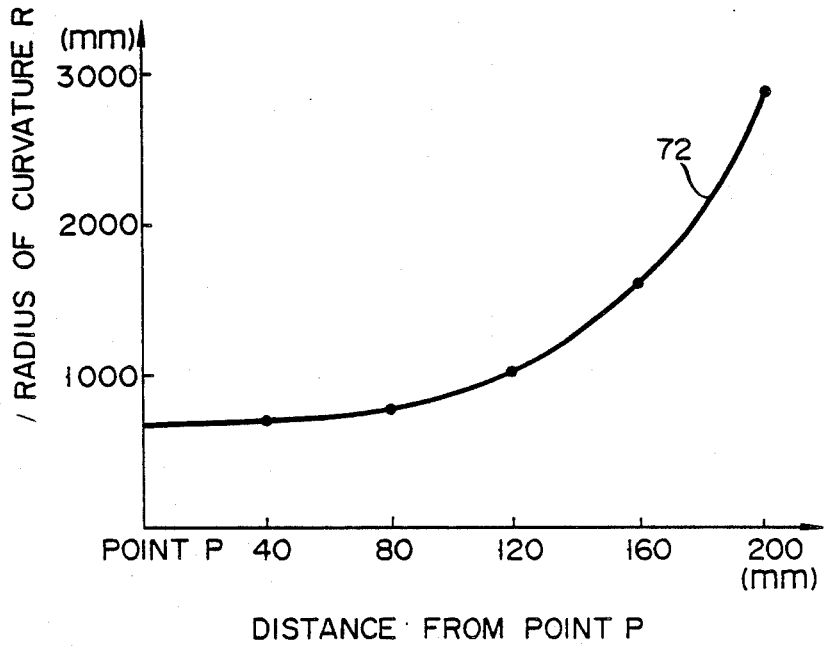
FIG. 10 is a graph showing the relationship between a radius of curvature and a distance from point P on the shadow mask according to the embodiment of the present invention.

FIG. 8 shows shadow mask 62 according to the embodiment of the present invention. FIGS. 9 and 10 show radius of curvature R of shadow mask 62. FIG. 9 shows radius of curvature R near the Y axis in a section of shadow mask 62 which is taken along an X-Z parallel plane which is moved in the Y-axis direction. FIG. 10 shows radius of curvature R near a dotted line passing through effective diameter points P and Q in minor axis direction shown in FIG. 8 in a section of shadow mask 62 which is taken along an X-Z parallel plane which is moved in the Y-axis direction. In curve 71 shown in FIG. 9, radius of curvature R is almost monotonously decreased from center 0 of the shadow mask toward effective diameter edge point N on the Y axis. Thus, at edge point N shown in FIG. 8, radius of curvature R is decreased to about 60% that at center 0. In curve 72 shown in FIG. 10, radius of curvature R is almost monotonously increased from effective diameter edge point P on the X axis toward effective diameter edge point Q at the corner. Thus, at edge point Q shown in FIG. 8, radius of curvature R is increased to about 4.5 times that at edge point P on the X axis.

In the X-axis direction of the effective curved surface of shadow mask 62, a portion around center 0 with large radius of curvature R is relatively flat, and a portion near point P with small radius of curvature R has a large change amount in the Z-axis direction. Thus, a portion between points 0 and L has almost no difference in distance in the Z-axis direction. A portion around point N with small radius of curvature R has a large change amount in the Z-axis direction, and a portion around point Q with large radius of curvature R is relatively flat. Thus, a portion between points N and M has a large difference in distance in the Z-axis direction. Therefore, shadow mask 62 can be formed to have a large difference in distance in the Z-axis direction between points L and M. Since a difference in distance in the Z-axis direction (change amount) from point L on the X axis to point M at the middle of an edge portion can be increased, radius of curvature R in a section taken along a Y-Z parallel plane between points L and M of shadow mask 62 can be reduced. Thus, mislanding caused by thermal deformation on a region near point M of shadow mask 62 can be effectively corrected. For a portion near an edge portion between points Q and P, since radius of curvature R in a section taken along an X-Z parallel plane at the corner near point Q is large, a difference in distance in the Z-axis direction between points P and Q can be reduced. Thus, shadow mask 62 can be formed to be substantially flat. Since shadow mask 62 can be formed so that radius of curvature R of the section taken along the X-Z parallel plane is monotonously changed, it can provide a simple structure.

According to another embodiment, panel 51 can be formed to have the same shape as that of shadow mask 62. More specifically, radius of curvature R near the Y axis in a section of the panel taken along an X-Z parallel plane is monotonously decreased from the central portion of the panel toward the effective diameter edge portion on the Y axis. Radius of curvature R of the effective diameter edge portion in a section of the panel taken along an X-Z parallel plane is monotonously increased from a portion on the X axis toward the corner portion. Therefore, since the panel can be formed to have a flat central portion, an incident angle of external light can be decreased. Thus, fatigue of eyes due to a high-contrast image displayed on the panel surface can be eliminated. Since radius of curvature R near the corner in a section of the panel taken along an X-Z parallel plane can be increased, a difference in distance in the Z-axis direction between the central portion and corner of the panel can be decreased.

A combination of the shadow mask and the panel in the above embodiments can be used. When the shadow mask and the panel of the above embodiments are used, a flat panel and a shadow mask which is easy to manufacture are provided. A 30" 110° deflection color cathode ray tube manufactured according to the above embodiments could eliminate about 20% of mislanding of the conventional color cathode ray tube.

It should be noted that unless radii of curvature between center 0 and point N and between points P and Q are respectively changed to some extent, the effect of the present invention cannot be expected. A difference in radius of curvature is preferably 10% or more. However, if radius of curvature near point N is too large, a difference in distance in the Z-axis direction from point L to point M is decreased, and the effect of the present invention cannot be achieved. Therefore, assuming that diagonal effective diameter of color-CRT is given as S mm, radius of curvature near point N is preferably set to be 2.5S mm or less. Practical numerical data of a 30" 110° deflection color cathode ray tube combining the above embodiments are as follows. R1 is a radius of curvature at center 0, R2 is a radius of curvature at point N, R3 is a radius of curvature at point P, and R4 is a radius of curvature at point Q.

| | | |
|---|---|---|
| R1: | outer surface of panel | 2460 mm |
| | inner surface of panel | 2300 mm |
| | shadow mask | 1810 mm |
| R2: | outer surface of panel | 1550 mm |
| | inner surface of panel | 1350 mm |
| | shadow mask | 1120 mm |
| R3: | outer surface of panel | 780 mm |
| | inner surface of panel | 650 mm |
| | shadow mask | 540 mm |
| R4: | outer surface of panel | 1370 mm |
| | inner surface of panel | 2960 mm |
| | shadow mask | 1510 mm |

When the radius of curvature near point Q is set to be equal to or larger than that near point N, the effect of the present invention can be enhanced, as can be understood from the above description.

Figure 11:
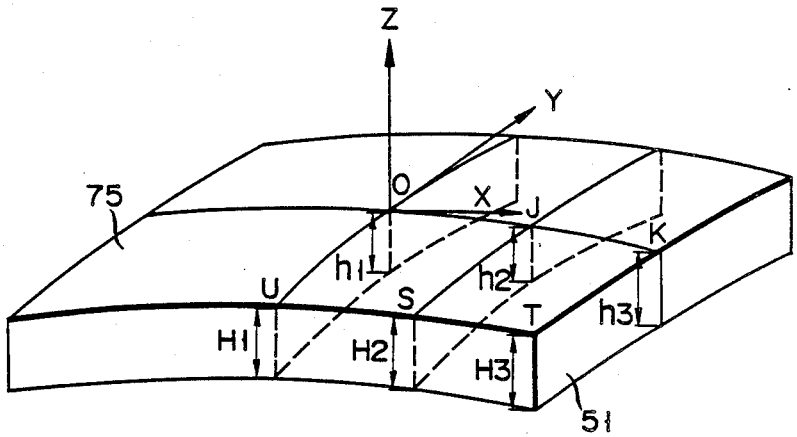
FIG. 11 is a cutaway perspective view of a panel according to the embodiment of the present invention.
Figure 12:
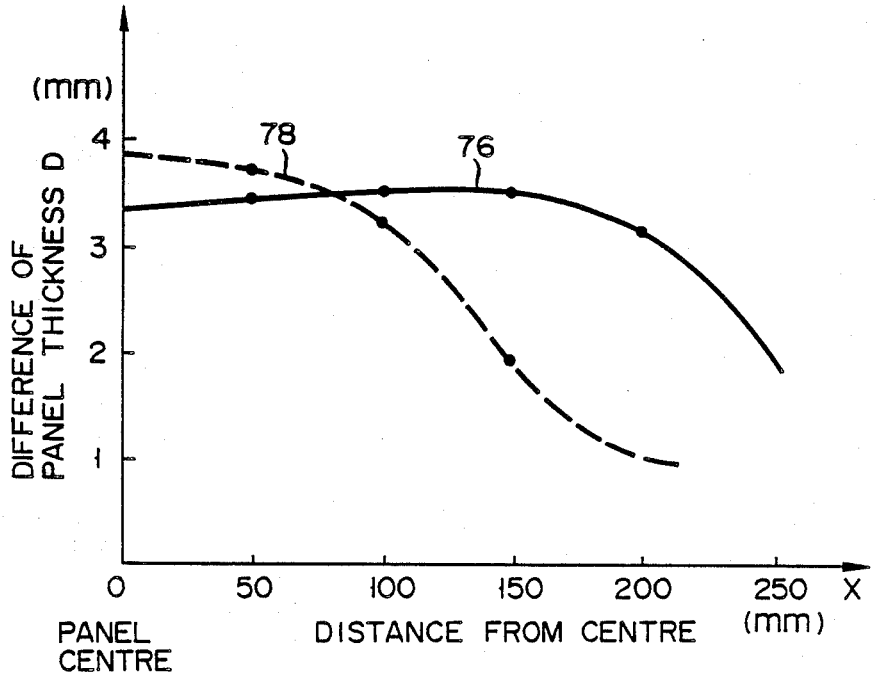
FIG. 12 is a graph showing the relationship between a difference in thickness and a distance from the center of the panel according to the embodiment of the present invention.

FIGS. 11 and 12 show a third embodiment of the present invention. On effective region 75 of panel 51 shown in FIG. 11, the tube axis passing through center 0 of panel 51 is defined as a Z axis, a major-axis direction perpendicular to the Z axis and passing through center 0 of panel 51 is defined as an X axis, and a minor-axis direction perpendicular to the Z and X axes and passing through center 0 of panel 51 is defined as a Y axis. An edge portion of panel 51 in the X-axis direction from center 0 is indicated by point K, and an edge portion of panel 51 in the Y-axis direction is indicated by point U. Point J is located between points 0 and K. An edge portion of a Y-Z parallel plane passing through point K is defined as point T, and an edge portion of a Y-Z parallel plane passing through point K is defined as point S. The thickness of panel 51 at center 0 of panel 51 in a section along the Y-Z plane is defined as h1, and the thickness at point U of the edge portion on the Y axis is defined as H1. A difference between h1 and H1 is defined as D1. The thickness of panel 51 at point J is defined as h2, and the thickness at point S is defined as H2. A difference between h2 and H2 is defined as D2. Difference D1 is smaller than difference D2. The thickness of panel 51 at point K is defined as h3, and the thickness at point T is defined as H3. A difference between h3 and H3 is defined as D3. Difference D3 is smaller than difference D2. These parameters are expressed as:

$$D2 = H2 - h2 > H1 - h1 = D1$$

$$D2 = H2 - h2 > H3 - h3 = D3$$

FIG. 12 shows a change in difference D of the thicknesses from point 0 to point K. Solid curve 76 indicates difference D of the thickness according to the present invention, and dotted curve 78 indicates a difference of a thickness in a conventional CRT. In the related art indicated by dotted curve 78, a difference of the thickness is largest at X = 0 (on the Y-Z plane), and is decreased in the X-axis direction. In the embodiment of the present invention indicated by solid curve 76, panel 51 is formed such that difference D of the thickness becomes maximum between points 0 and K.

Practical numerical data of a 30" 110° deflection color cathode ray tube of this embodiment are as follows. In this case, a value of x is a distance from the center in the X-axis direction.

$$h1 = 13.5\ mm\ (x = 0\ mm)$$

$$h2 = 14.0\ mm\ (x = 150\ mm)$$

$$h3 = 16.6\ \text{mm}\ (x = 284\ \text{mm})$$

$$H1 = 17.1\ mm\ (x = 0\ mm)$$

$$H2 = 17.8\ mm\ (x = 50\ mm)$$

$$H3 = 17.0\ mm\ (x = 284\ mm)$$

Therefore, $$D1 = 3.6\ mm$$

$$D2 = 3.8\ mm$$

$$D3 = 0.4\ mm$$

In general, the following ranges are preferred:

$$8 < h1 < 20$$

$$0 < D1 < 10$$

$$0 < D2 - D1 < 2$$

$$0 < D2 - D3 < 8$$

Since the thicknesses of panel 51 can be changed as described above, even if the outer surface of the panel is formed to be flat, the radius of curvature near point J on the inner surface of the panel in a section along the Y-Z parallel plane can be decreased. Shadow mask 62 is molded to reduce mislanding of electron beams when shadow mask 62 thermally expands. Namely, the radius of curvature in a section taken along an Y-Z parallel plane near point J corresponding to a region of shadow mask 62 suffering from the largest thermal deformation is decreased. For this reason, even if the outer surface of the panel is formed to be substantially flat, mislanding caused by thermal deformation of the shadow mask can be efficiently eliminated. Mislanding caused by thermal deformation could be eliminated by about 15% in the 30" 110° deflection color cathode ray tube according to the embodiment of the present invention. As described above, although the color cathode ray tube has a region with a rather small thickness, the mechanical strength of this tube is large enough and no decrease in mechanical strength is observed.

The above-mentioned embodiments can be combined, so that the radius of curvature as well as the thickness of the panel can be changed. Thus, a color cathode ray tube substantially free from mislanding can be provided.

The above-mentioned embodiments can be combined so that the thickness of the panel and the radius of curvature of the shadow mask can be changed. Thus, a color cathode ray tube free from mislanding can be provided.

An embodiment wherein all the embodiments described above are combined is also available. In this embodiment, both the thickness and the radius of curvature of the panel are changed, and the radius of curvature of the shadow mask are changed. Thus, mislanding caused by thermal expansion of the shadow mask in the color cathode ray tube can be eliminated.

According to the present invention, although the panel has a substantially flat outer surface, the radius of curvature of a region of the shadow mask where mislanding easily occurs can be decreased. Thus, even if the shadow mask is locally and immediately heated, mislanding cannot easily occur. As a result, degradation of color purity of a color cathode ray tube with substantially the flat outer surface of the face plate can be effectively eliminated.

What is claimed is:

1. A color cathode ray tube comprising:

a vacuum chamber including a panel, a funnel, a neck, and a tube axis, said panel having a face plate having a substantially rectangular front surface and an inner surface, said funnel having a funnel shape and being contiguous with a skirt of said panel, aid neck being a substantially cylindrical shape and being contiguous with said funnel;

a phosphor screen formed on said inner surface of said face plate;

an electron gun assembly, arranged in said neck, for emitting three electron beams which impinge on said phosphor screen;

deflection means for deflecting the three electron beams;

a shadow mask arranged in said panel to oppose said phosphor screen, said shadow mask including a substantially rectangular effective curved surface and apertures for allowing the three electron beams from said electron gun assembly to pass therethrough, and on which said tube axis is defined as a Z axis, and major and minor-axis directions are respectively defined as X and Y axes having a center through which the Z axis passes as an origin, a radius of curvature at the center of said effective curved surface of said shadow mask in a section taken along on X-Z parallel plane being larger than a radius of curvature at an effective diameter edge portion on the Y axis, and a radius of curvature at an effective diameter edge portion on the X axis being smaller than a radius of curvature at a diagonal effective diameter edge portion; and supporting means for supporting said shadow mask.

2. A color cathode ray tube according to claim 1, wherein the radius of curvature is monotonously changed from the center of aid effective curved surface of said shadow mask toward a portion near the effective diameter edge portion on the Y axis, and is monotonously changed from a portion near the effective diameter edge portion on the X axis toward a portion near the diagonal effective diameter edge portion.

3. A color cathode ray tube according to claim 1, wherein the radius of curvature at the center of said effective curved surface of said shadow mask is changed by at least 10% compared to that at the effective diameter edge portion on the Y axis, and the radius of curvature at the effective diameter portion on the X axis changed by at least 10% compared with that at the diagonal effective diameter edge portion.

4. A color cathode ray tube according to claim 1, wherein the diagonal effective diameter is defined as S mm and the radius of curvature at the effective diameter edge portion on the Y axis is set to be not more than 2.5·S mm.

5. A color cathode ray tube according to claim 1, wherein the radius of curvature of a portion near the diagonal effective diameter edge portion is is at least the same as the radius of curvature of a portion near the effective diameter edge portion on the Y axis.

6. A color cathode ray tube comprising:

a vacuum chamber having a panel, a funnel, a neck and a tube axis, said panel having a face plate with a substantially rectangular effective curved surface and an inner surface, and the tube axis being defined as a Z axis, and major- and minor- axis directions being respectively defined as X and Y axes having the center of said face plate through which the Z axis passes as an origin, and on said face plate, a radius of curvature at the center of said effective curved surface of said face plate in a section taken along an X-Z parallel plane being larger than a radius of curvature at an effective diameter edge portion on the Y axis, and a radius of curvature at an effective diameter edge portion on the X axis being smaller than a radius of curvature at a diagonal effective diameter edge portion, said funnel having a funnel shape and being contiguous with a skirt of said panel, and said neck being formed into a substantially cylindrical shape and being contiguous with said funnel;

a phosphor screen formed on said inner surface of said face plate;

an electron gun assembly, arranged in said neck, for emitting three electron beams which impinge on said phosphor screen;

deflection means for deflecting the electron beams;

a shadow mask arranged in said panel so as to oppose said phosphor screen and having a substantially rectangular effective curved surface and apertures for allowing the three electron beams from said electron gun assembly to pass therethrough; and supporting means for supporting said shadow mask.

7. A color cathode ray tube according to claim 6, wherein said effective curved surface having the radius of curvature comprises said inner surface of said face plate.

8. A color cathode ray tube according to claim 6, wherein the radius of curvature is monotonously changed from the center of said effective curved surface of said face plate toward a portion near the effective diameter edge portion on the Y axis, and is monotonously changed from a portion near the effective diameter edge portion on the X axis toward a portion near the diagonal effective diameter edge portion.

9. A color cathode ray tube according to claim 6, wherein the radius of curvature at the center of said effective curved surface of said face plate is changed by at least 10% compared to that at the effective diameter edge portion on the Y axis, and the radius of curvature at the effective diameter portion on the X axis is changed by at least 10% compared with that at the diagonal effective diameter edge portion.

10. A color cathode ray tube according to claim 6, wherein the diagonal effective diameter is defined as S mm and radius of curvature at the effective diameter edge portion on the Y axis is set to be not more than 2.5·S mm.

11. A color cathode ray tube according to claim 6, wherein the radius of curvature of a portion near the diagonal effective diameter edge portion is at least the same as the radius of curvature of a portion near the effective diameter edge portion on the Y axis.

12. A color cathode ray tube comprising:

a vacuum chamber including a panel, a funnel, a neck, and a tube axis, and in which said panel has a face plate having a substantially rectangular front surface and an inner surface, said funnel being formed into a funnel shape and being contiguous with a skirt of said panel, and aid neck being formed into a substantially cylindrical shape and being contiguous with said funnel;

a phosphor screen formed on said inner surface of said face plate;

an electron gun assembly, arranged in said neck, for emitting three electron beams which impinge on said phosphor screen;

deflection means for deflecting the three electron beans;

a shadow mask arranged in said panel to oppose said phosphor screen and having a substantially rectangular effective curved surface and apertures for allowing the three electron beams from said electron gun assembly to pass therethrough;

in said panel, said tube axis is defined as a Z axis and major- and minor-axis directions are respectively defined as X and Y axes having a center through which the Z axis passes as an origin, a difference between a thickness at an effective diameter edge portion and a thickness on the X axis in a section of said panel taken along a Y-Z parallel plane moved in the X-axis direction being maximum at a position between the center of said panel and the effective diameter edge portion on the X axis; and supporting means for supporting said shadow mask.

13. A color cathode ray tube comprising:

a vacuum chamber including a panel, a funnel, a neck and a tube axis, said panel having a face plate having a substantially rectangular effective curved surface and an inner surface, said tube axis being defined as a Z axis, and major- and minor- axis direction being respectively defined as X and Y axes having a center of said face plate through which the Z axis passes as an origin, on said face plate, a radius of curvature at the center of said effective curved surface of said face plate in an section taken along an X-Z parallel plane being larger than a radius of curvature at an effective diameter edge portion on the Y axis, and a radius of curvature at an effective diameter edge portion on the X axis being smaller than a radius of curvature at a diagonal effective diameter edge portion, said funnel having a funnel shape and being contiguous with a skirt of said panel, and said neck being a substantially cylindrical shape and being contiguous with said funnel;

a phosphor screen formed on said inner surface of said face plate;

an electron gun assembly, arranged in said neck, for emitting three electron beams which impinge on said phosphor screen;

deflection means for deflecting the electron beams;

a shadow mask arranged in said panel so as to oppose said phosphor screen, and having a substantially rectangular effective curved surface and apertures for allowing the three electron beams from said electron gun assembly to pass therethrough, and on which a radius of curvature at a center of said effective curved surface of said shadow mask in a section taken along an X-Z parallel plane is larger than a radius of curvature at an effective diameter edge portion on the Y axis, and a radius of curvature at an effective diameter edge portion on the X axis is smaller than a radius of curvature at a diagonal effective diameter edge portion; and supporting means for supporting said shadow mask.

* * * * *